US009125474B2

(12) United States Patent
Gueret

(10) Patent No.: US 9,125,474 B2
(45) Date of Patent: Sep. 8, 2015

(54) APPLICATOR FOR APPLYING A COMPOSITION TO THE EYELASHES OR THE EYEBROWS

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 1865 days.

(21) Appl. No.: 11/819,098

(22) Filed: Jun. 25, 2007

(65) Prior Publication Data

US 2008/0023020 A1 Jan. 31, 2008

Related U.S. Application Data

(60) Provisional application No. 60/837,620, filed on Aug. 15, 2006.

(30) Foreign Application Priority Data

Jun. 28, 2006 (FR) ..... 06 05831

(51) Int. Cl.

| | |
|---|---|
| ***A46B 9/00*** | (2006.01) |
| ***A45D 40/26*** | (2006.01) |
| ***A46B 9/02*** | (2006.01) |

(52) U.S. Cl.

CPC ..... *A45D 40/265* (2013.01); *A45D 40/267* (2013.01); *A46B 9/021* (2013.01); *A46B 9/028* (2013.01); *A46B 2200/106* (2013.01); *A46B 2200/1053* (2013.01)

(58) Field of Classification Search

CPC ..... A45D 40/265; A04B 9/006
USPC ..... 132/218, 318, 320; 15/167.1, 206, 207
See application file for complete search history.

(56) References Cited

U.S. PATENT DOCUMENTS 4,422,986 A * 12/1983 Cole ..... 264/39
5,482,059 A 1/1996 Miraglia (Continued)

FOREIGN PATENT DOCUMENTS

CN 1714700 A 1/2006
CN 1742644 A 3/2006

(Continued)

OTHER PUBLICATIONS

Aug. 29, 2014 Notification according to Article 94(3) EPC issued in European Patent Application No. 07 301 151.2.

(Continued)

*Primary Examiner* — Todd Manahan
*Assistant Examiner* — Brianne Kalach
(74) *Attorney, Agent, or Firm* — Oliff PLC

(57) ABSTRACT

The present invention relates to an applicator for applying a composition to the eyelashes or the eyebrows, the applicator comprising:

an elongate core that extends along a longitudinal axis; and at least two rows of teeth that are connected to respective and different longitudinal faces of the core, each row of the at least two rows comprising:

a first set of first teeth that are connected to the corresponding longitudinal face of the core and that form a first angle with the normal; and a second set of second teeth that are connected to the corresponding longitudinal face of the core and that form a second angle with the normal, the core being observed along its longitudinal axis;

the second angle being greater than the first angle;

and/or at least one first tooth of the first set and at least one second tooth of the second set having free ends that are situated at different distances from the longitudinal axis of the core.

51 Claims, 9 Drawing Sheets

(56) References Cited

U.S. PATENT DOCUMENTS

| | | | | |
|---|---|---|---|---|
| 5,884,634 | A * | 3/1999 | Sheffler et al. | 132/218 |
| 6,343,607 | B1 * | 2/2002 | Gueret | 132/218 |
| 6,539,950 | B1 * | 4/2003 | Gueret | 132/218 |
| 6,581,610 | B1 | 6/2003 | Gueret | |
| 2002/0011251 | A1 | 1/2002 | Gueret | |
| 2002/0020424 | A1 * | 2/2002 | Gueret | 132/218 |
| 2002/0020426 | A1 * | 2/2002 | Gueret | 132/218 |
| 2006/0002758 | A1 | 1/2006 | Gueret | |
| 2007/0033759 | A1 | 2/2007 | Dumler | |
| 2008/0286030 | A1 * | 11/2008 | Roder | 401/129 |

FOREIGN PATENT DOCUMENTS

| | | | |
|---|---|---|---|
| EP | 1 046 358 | A1 | 10/2000 |
| EP | 1 050 231 | A1 | 11/2000 |
| EP | 1 070 465 | A2 | 1/2001 |
| EP | 1 070 466 | A2 | 1/2001 |
| EP | 1 070 467 | A2 | 1/2001 |
| EP | I070 468 | A1 | 1/2001 |
| EP | 1 155 637 | A1 | 11/2001 |
| EP | 1 475 013 | A1 | 11/2004 |
| EP | 1 481 607 | A1 | 12/2004 |
| EP | 1 561 394 | A2 | 8/2005 |
| EP | 1 611 817 | A1 | 1/2006 |
| EP | 1 632 149 | A2 | 3/2006 |
| FR | 2 856 559 | A1 | 12/2004 |
| JP | A-2001-231627 | | 8/2001 |
| JP | A-2006-051350 | | 2/2006 |
| WO | WO 01/05272 | A1 | 1/2001 |
| WO | WO 01/05273 | A1 | 1/2001 |
| WO | WO 2007/004156 | A1 | 1/2007 |

OTHER PUBLICATIONS

Dec. 18, 2012 Office Action issued in Japanese Patent Application No. 2007-193915.

* cited by examiner

APPLICATOR FOR APPLYING A COMPOSITION TO THE EYELASHES OR THE EYEBROWS

This non provisional application claims the benefit of French Application No. 06 05831 filed on Jun. 28, 2006 and U.S. Provisional Application No. 60/837,620 filed on Aug. 15, 2006.

FIELD OF THE INVENTION

The present invention relates to an applicator for applying a cosmetic, makeup, or a care product to the eyelashes or the eyebrows, the applicator including an applicator member comprising at least one row of teeth disposed on a core.

The invention also relates to a packaging and applicator device comprising such an applicator and a receptacle for containing the composition for application.

The invention also relates to a cosmetic treatment using such an applicator.

BACKGROUND

Numerous applicators of the above-mentioned type are known, in particular from applications EP-A-1 070 465, EP-A-1 070 466, EP-A-1 070 467, EP-A-1 070 468, WO 01/05272, WO 01/05273, EP-A-1 611 817, EP 1 632 149, and US 2007/0033759.

Publication EP-A-1 611 817 discloses an applicator including a core, on each of the longitudinal faces of which there are connected two rows of teeth extending in respective directions that are not parallel to each other. Each row comprises teeth that are disposed in a staggered configuration on opposite sides of a geometrical separation surface that extends along the row. The teeth of a row present plane faces that are directed towards the corresponding geometrical separation surface.

Publication EP-A-1 070 468 describes applicators having teeth that extend substantially flush with an adjacent face of the core.

Publication US 2007/0033759 describes an applicator including a core having two opposite longitudinal faces that carry rows of teeth that extend radially.

SUMMARY

The invention seeks to improve still further applicators for applying a composition to the eyelashes or the eyebrows, in particular in terms of the ability of the teeth to penetrate into the eyelashes, smoothing the composition on the eyelashes, and separating said eyelashes.

In addition, some applicators having teeth that are not radial need to be made out of thermoplastic materials that are relatively flexible since the teeth need to be able to flex during unmolding. However, in some circumstances more rigid teeth could be desirable, e.g. for passing with less deformation through a wiper member, and for carrying a greater load of composition. The invention also seeks to make it possible, if necessary, to make the applicator member by molding a thermoplastic material that is relatively hard.

In one of its aspects, the invention provides an applicator for applying a composition to the eyelashes or the eyebrows, the applicator comprising:

an elongate core that extends along a longitudinal axis; and at least one row of teeth, better at least two rows of that teeth, that is/are connected to the core, in particular to respective and different longitudinal faces of the core, the or each row of the at least two rows comprising:

a first set of first teeth that are connected to the longitudinal face of the core and that form a first angle with the normal that may be zero or small; and a second set of second teeth that are connected to the corresponding longitudinal face of the core and that form a second angle with the normal, the core being observed along its longitudinal axis;

the second angle being greater than the first angle; and/or at least one first tooth of the first set and at least one second tooth of the second set having free ends that are situated at different distances from the longitudinal axis of the core.

The term "longitudinal axis" should be understood as the line that joins the barycenters (centers of gravity) of the cross-sections of the core. In some circumstances, the longitudinal axis may be a central axis, or even an axis of symmetry for the core, in particular when the core presents a cross-section that has the general shape of a regular polygon.

In one of its aspects, the invention also provides an applicator for applying a composition to the eyelashes or the eyebrows, the applicator comprising:

an elongate core that extends along a longitudinal axis; and at least one row of teeth, better at least two rows of that teeth, that is/are connected to the core, in particular to respective and different longitudinal faces of the core, the or each row of the at least two rows comprising:

a first set of first teeth that are connected to the longitudinal face of the core and that form a first angle with the normal that may be zero or small; and a second set of second teeth that are connected to the corresponding longitudinal face of the core and that form a second angle with the normal, the core being observed along its longitudinal axis;

the second angle being greater than the first angle; and/or at least one first tooth of the first set and at least one second tooth of the second set having free ends that are situated at different heights relative to the face of the core to which the teeth are connected.

The second angle may be greater than the first.

A first tooth of the first set and a second tooth of the second set of each of the at least two rows may have free ends that are situated at different distances from the longitudinal axis of the core.

A second tooth of the second set may be offset laterally on the core relative to at least one first tooth of the first set, such that their respective free ends are spaced apart angularly by an angle that is strictly greater than 0°, about the longitudinal axis of the core. The angle may be greater than 1°, better 5°, still better 10°.

At least two successive teeth of the first set of first teeth and/or of the second set of second teeth may have heights that are different or equal.

The teeth of the second set may have a height that is greater than the height of the teeth of the first set.

The core may have a cross-section that varies in geometrically similar manner along its longitudinal axis. For example, it may increase over a first portion of the core, from a head of the applicator towards a proximal end of the core, then decrease and increase over a second portion of the core, passing through a minimum, and decrease once again over a third portion of the core, from the proximal end of the second portion to an endpiece of the applicator.

By way of example, the applicator may include 30 to 60 teeth on each of its longitudinal faces, e.g. about 42 teeth.

Each of the second teeth may have a face that forms an angle with the normal to the face to which a tooth of the second set of second teeth is connected that lies in the range 25° to 30°.

By way of example, at a location along the longitudinal axis of the core, the applicator may include 10 to 15 teeth over 360° about the longitudinal axis of the core.

In the cross-section plane under consideration, when the longitudinal face under consideration is straight, the normal to the face is defined as being the perpendicular to said face.

In the cross-section plane under consideration, when the longitudinal face is curvilinear between two ends that belong to the longitudinal edges of the face, the normal is defined as being the perpendicular to the chord that connects said two ends.

When the longitudinal axis is rectilinear, the cross-section is perpendicular to the axis.

When the longitudinal axis is curvilinear, the cross-section, at any point along the core, is perpendicular to the tangent to the axis at that point.

In an embodiment of the invention, some teeth are connected via a surface of the tooth that is oriented obliquely or perpendicularly relative to the longitudinal face of the core, and others are connected via a surface of the tooth that is oriented obliquely, thereby making it possible to have teeth having lengths that are similar, while their free ends are at different distances from the core.

When observed in cross-section, the envelope surface of the applicator member may thus be non-circular, and when turned about the core, it may pass alternately from a distance to the core that is greater than a mean radius to a distance to the core that is less than the mean radius, and vice versa, for example.

The envelope surface may have a conical or pyramidal shape at least an end of the core, for example the end that connects to the stem. The envelope surface may be conical or pyramidal diverging when going away from the stem starting from the stem.

The fact that the free ends of the teeth are not all situated at the same distance from the longitudinal axis may improve the ability of the teeth to penetrate into the eyelashes, in particular while the applicator is being turned relative to the eyelashes during application.

By adapting the shape of the teeth and their spacing, it is possible to establish cavities of greater or small size between the teeth, such cavities being suitable for being loaded with composition. It is thus possible to make a row of teeth that is capable of being loaded with a substantial quantity of composition, but without the row of teeth losing its capacity to grip the eyelashes.

In embodiments of the invention, the teeth may be made relatively easily by molding or overmolding with the core.

The applicator may be made with a disposition of teeth on the core that makes it easier for the eyelashes to come into contact with said core, which may present a surface state that is perfectly defined, which is not always true of a conventional brush having a twisted core.

In an embodiment of the invention, the eyelashes may be loaded with composition that is in contact with the core. The core may thus participate in active manner in applying composition to the eyelashes, thereby offering more freedom in the choice and the arrangement of the teeth.

The term "row" means a succession of teeth that are generally situated on the same side of the core, and that succeed one another along the core.

The teeth of at least one row may be connected to the longitudinal face of the corresponding core on the same side of a middle longitudinal line of the longitudinal face of the core.

The teeth of the first and/or second set of teeth may be substantially straight.

The teeth may have bases that are not centered on the longitudinal face of the core to which they are connected.

The bases of the teeth in a row may be in alignment, or they may be disposed in a staggered configuration. For a staggered configuration, a plurality of consecutive teeth of the row may be offset at least in part, alternately on opposite sides of a geometrical separation surface. The consecutive teeth may be offset completely, alternately on opposite sides of the geometrical separation surface. The term "offset completely" should be understood as the geometrical separation surface not passing through the teeth, being a tangent to said teeth at the closest.

All of the teeth of each row may be offset alternately on opposite sides of a geometrical separation surface that is associated with the row.

Two consecutive teeth of a row need not be images of each other simply shifted in translation, in particular when the cross-sections of the teeth are non-circular in shape.

The teeth of the above-mentioned first and second sets may be disposed in alternation within at least one row.

At least two consecutive teeth of a row of teeth may have first faces both having a common first shape, e.g. plane, in particular at least at the bottom portion of the tooth, and second faces both having a common second shape, e.g. not plane, in particular rounded. The first faces may all face in the same direction around the core, i.e. they may all face clockwise or anticlockwise, when the core is observed along its longitudinal axis.

The first faces, in particular when they are plane, may extend substantially flush with a longitudinal face of the core, which longitudinal face is adjacent to the longitudinal face to which the teeth are connected. Such a disposition makes it easier to mold the applicator member.

The first faces of the teeth, in particular when they are plane, may be connected substantially perpendicularly to the corresponding face of the core, at least for some teeth in the row.

The cross-section of at least one tooth, or even of each tooth, may be of substantially semi-circular or semi-elliptical shape, or it may be of still some other shape.

At least one tooth of a row may extend, at least at its portion that is connected to the core, or even over its entire length, along a first direction $Z_1$, perpendicular to the longitudinal face of the core to which the tooth is connected, or forming a small angle with the normal, e.g. less than 10°, better 5°. A consecutive tooth of the row may extend from the same face of the core along a second direction $Z_2$, at least at the portion that is connected to the core, or even over its entire length, forming an angle $\alpha$ with the first direction, when the core is observed along its longitudinal axis.

Substantially half of the teeth of a row may extend parallel to the first direction $Z_1$. The angle $\alpha$ between the directions $Z_1$ and $Z_2$ may lie in the range 5° to 80°.

At least two consecutive teeth of a row need not be touching. At least two consecutive teeth of the row may be separated by a non-zero distance that is measured along the longitudinal axis of the row, the distance lying in the range 0.01 millimeters (mm) to 1 mm.

The core may include a plurality of longitudinal faces, as mentioned above, and the applicator may include rows of teeth, each extending from one of the longitudinal faces of the core.

The teeth may be attached perpendicularly to the core or they may be attached at an angle such that all of the teeth face in the same direction around the core, when the core is observed along its longitudinal axis. The applicator member may thus not have teeth that face in opposite directions around the core. For example, when the core is observed from its distal end, all of the teeth that extend obliquely may face in the clockwise direction.

The applicator may include a single row of teeth per longitudinal face of the core.

By way of example, the applicator may include 2 to 10 rows in all, in particular 3 to 8 rows, having an even number of rows, for example.

The length of a row may lie in the range about 10 mm to 45 mm, in particular in the range 15 mm to 35 mm, or even in the range 20 mm to 30 mm, e.g. being about 25 mm.

When the core is observed along its longitudinal axis, it is possible to pass from one row to another by turning the core about its longitudinal axis through an integer sub-multiple of 360°, e.g. turning through 360°/n, where n is an integer that lies in the range 2 to 8, for example.

In a cross-section plane, the core may present axial symmetry, in particular about its longitudinal axis.

The core may extend along a longitudinal axis that is rectilinear. In a variant, the core may extend along a longitudinal axis that is curved. The core may extend along a longitudinal axis that, at least one point along its length, forms an angle with the longitudinal axis of a stem to which the core is fastened. The core may be bent where it connects to the stem.

The free ends of the teeth may define an envelope surface that extends along a longitudinal axis that forms a non-zero angle with the longitudinal axis of the core.

The core may include at least one longitudinal face that is plane. In a variant, the core may include at least one longitudinal face that is not plane, e.g. being concave or convex, at least in part.

At least one tooth, or even each tooth of a row or of the applicator, may extend from a corresponding non-plane longitudinal face of the core in a manner that is substantially perpendicular to a plane that is tangential to the core at said tooth.

The core may include a longitudinal face that is concave or convex in cross-section, and that has concavity or convexity that may vary along the longitudinal axis of the core.

The core may include a longitudinal face that is twisted.

The applicator may include teeth of different heights or of the same height. The height of the teeth may lie in the range 0.5 mm to 4 mm, in particular in the range 0.7 mm to 3 mm, or even in the range 1 mm to 2 mm. Within a row of teeth, the number of teeth may lie in the range about 6 to 60, in particular in the range about 10 to 45, e.g. lying in the range 40 to 45.

At least one row of teeth may extend along a rectilinear axis that may optionally be parallel to the longitudinal axis of the core.

At least two teeth of at least one row may present lengths that are different or identical. At least two teeth of at least one row may present shapes that are different or identical. At least one tooth of at least one row may present a general shape that tapers towards its free end.

When the applicator includes a plurality of rows of teeth, at least one tooth of one of the rows may present a shape that is different from a tooth of another row. At least one tooth of a row may present a length that is different from the length of another tooth of said row, in particular a consecutive tooth, for example.

When the core is observed along its longitudinal axis, two teeth of a row may extend at their bases in directions that form a first angle between them, and two teeth of another row may extend at their bases in directions that form a second angle between them, the first and second angles being equal or different.

Within each row, the teeth may be spaced-apart evenly along the longitudinal axis of the row, or they may be grouped together in groups of two or more teeth, the distance between the teeth of one group along the longitudinal axis of the row being less than the distance between two adjacent groups of teeth of said row.

Initially, the teeth may be separate from the core, and then fastened to said core so as to form the applicator. In a variant, the teeth may be made integrally with the core, e.g. by molding, in particular by injection-molding. The teeth may be formed by monoinjecting material or by overinjecting, preferably using a thermoplastic material which may be elastomeric.

The teeth may be made of a material that is more rigid or less rigid than a material that is used to make the stem of the applicator to which the core is connected.

At least one of the core and a tooth may present magnetic properties. By way of example, the magnetic properties may result from a filler of magnetic particles that are dispersed in the plastics material of the core and/or of the tooth.

At least one of the core and a tooth may be flocked and/or may include a filler for improving sliding, for example.

The core may be constituted by a separate piece that is fitted to the stem of the applicator. In a variant, the core may be made integrally with the stem of the applicator by molding a plastics material The core may be made of a plastics material that is more flexible or less flexible than the plastics material that is used to make the stem of the applicator.

The core may present a cross-section that is substantially constant, at least over a fraction of its length. The core may also present a cross-section that varies. The cross-section of the core may pass through an extremum that is substantially mid-way along the core, the extremum being a minimum, for example. This may impart increased flexibility to the core, and makes it possible to define an envelope surface of section that varies along the applicator member.

Over at least a fraction of its length, the core may present a cross-section having the shape of a polygon that is optionally regular, and that is preferably regular, e.g. triangular, rectangular, square, pentagonal, hexagonal, or octagonal, the sides corresponding to the longitudinal faces of the core possibly being straight or slightly concave or convex.

The core may thus present a cross-section that is not circular over the major portion of its length.

The core may be fastened to a first end of the stem of the applicator. The core may be fastened to the stem of the applicator by inserting an endpiece that extends the visible portion of the core into a housing formed at the end of the stem. In a variant, the core may include a housing that extends longitudinally, and into which the stem is inserted.

Irrespective of how the core is connected to the stem, said stem may be provided with a handle that may be configured so as to close, in leaktight manner, a receptacle containing the composition for application. The receptacle may include a wiper member that may be adapted to wipe the stem and the applicator member.

The applicator need not contain any metal, thereby making it possible to put it in a microwave oven.

Where appropriate, the core may have a hollow inside, and it may include at least one hole enabling the composition to pass through the applicator member.

In another of its aspects, and independently or in combination with the above, the invention also provides an applicator comprising:

a core that extends along a longitudinal axis and that presents a plurality of longitudinal faces; and a single row of teeth that extend from each of at least two longitudinal faces of the core, in particular from each longitudinal face of the core, at least one first set of first teeth of said row having a surface that is connected obliquely or perpendicularly to the corresponding longitudinal face of the core, and at least one second set of second teeth of said row having a surface that is connected obliquely to the same longitudinal face of the core, when said core is observed along its longitudinal axis.

At least one first tooth of the first set and at least one second tooth of the second set may be connected to the corresponding longitudinal face of the core in different directions. The teeth of the first set of teeth may be substantially straight.

Independently or in combination with the above, the invention also provides an applicator for applying a composition to the eyelashes or the eyebrows, the applicator comprising:

a core that extends along a longitudinal axis and that presents at least two longitudinal faces; and at least two rows of teeth on two respective longitudinal faces of the core, the teeth having first longitudinal faces that are plane over substantially their entire height, and second longitudinal faces, on a side opposite from the first faces, that are not plane, the plane first longitudinal faces facing in the same direction around the core.

Independently or in combination with the above, the invention also provides an applicator for applying a composition to the eyelashes or the eyebrows, the applicator comprising:

a core that extends along a longitudinal axis and that includes at least two longitudinal faces; and at least two rows of teeth on the core, each extending from a longitudinal face of the core;

a plurality of consecutive teeth of a row being offset, at least in part, alternately on opposite sides of a geometrical separation surface, each of the teeth of the plurality including a first face having a common shape, the first faces facing in the same direction around the core, two consecutive teeth of the plurality having longitudinal axes that form a non-zero between them, when the core is observed along its longitudinal axis.

In another of its aspects, the invention also provides an applicator including an applicator member having a core that is elongate along a longitudinal axis, and that has a cross-section that is polygonal over at least a fraction of its length, at least one row of teeth being connected to a longitudinal face, the row including at least one tooth having a face that extends in the plane of the adjacent longitudinal face, and a tooth that extends obliquely, when the core is observed along its longitudinal axis.

The invention also provides a packaging and applicator device for applying a composition to keratinous fibers, in particular the eyelashes or the eyebrows, the device comprising any one of the applicators as defined above, and a receptacle containing the composition.

The receptacle may include a wiper member.

The invention also provides a method of applying makeup to the eyelashes or the eyebrows by means of an applicator as defined above.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
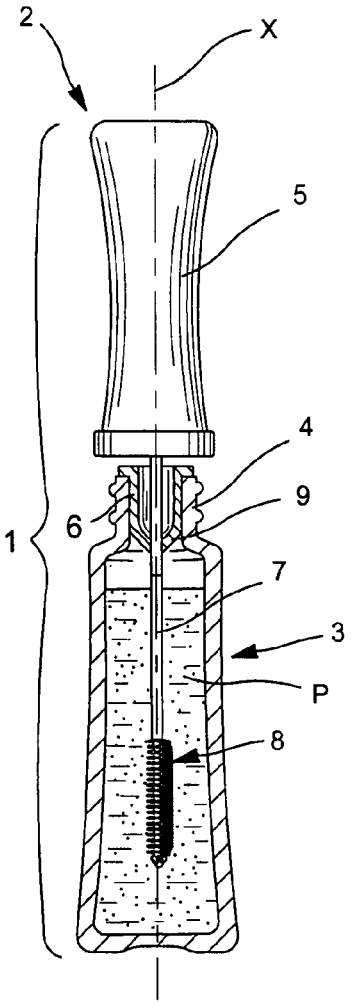
FIG. 1 is a diagrammatic elevation view, partially in longitudinal section, showing an example of a device constituting an embodiment of the invention.

FIG. 1 shows a packaging and applicator device constituting an embodiment of the invention, the device comprising an applicator 2 and an associated receptacle 3 containing a composition P for application to the eyelashes and/or the eyebrows, e.g. mascara or a care product.

In the embodiment under consideration, the receptacle 3 includes a threaded neck 4, and the applicator 2 includes a closure cap 5 that is arranged so as to be fastened on the neck 4 in order to close the receptacle 3 in leaktight manner when not in use, the closure cap 5 also constituting a handle for the applicator 2.

The applicator 2 includes a stem 7 of longitudinal axis Y, which stem is connected at its top end to the closure cap 5 and at its bottom end to an applicator member 8.

The receptacle 3 also includes a wiper member 6 that is inserted in the neck 4.

Although, the wiper member 6 could be of any kind, it includes a lip 9 that is arranged so as to wipe the stem 7 and the applicator member 8 while the applicator 2 is being removed from the receptacle 3.

In the embodiment shown, the stem 7 presents a cross-section that is circular, but it is not beyond the ambit of the present invention for the stem 7 to present some other section, it then being possible, where necessary, for the cap 5 to be fastened on the receptacle 3 other than by screw-fastening. The wiper member 6 could be adapted to the shape of the stem 7 and to the shape of the applicator member 8, where appropriate.

In the embodiment under consideration, the longitudinal axis Y of the stem 7 is rectilinear and coincides with the longitudinal axis of the receptacle 3 when the applicator 2 is in place on said receptacle, but it is not beyond the ambit of the present invention for the stem 7 to be non-rectilinear, forming a bend, for example.

Where appropriate, the stem 7 can include an annular constriction over its portion that comes to be positioned level with the lip 9 of the wiper member 6, so as to avoid mechanically stressing said lip unduly during storage.

Figure 3:
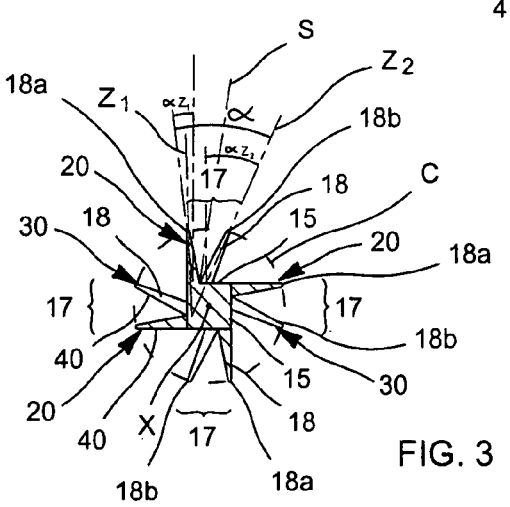
FIGS. 3 and 4 are cross-sections on III-III and IV-IV respectively in FIG. 2.
Figure 4:
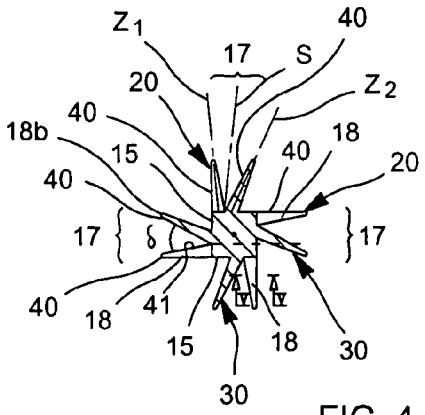
Figure 2:
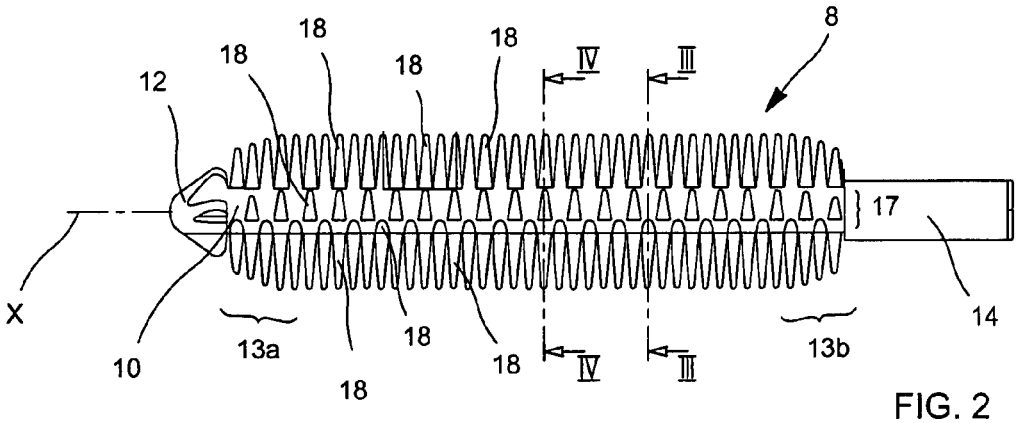
FIG. 2 is a side view showing the FIG. 1 applicator member in isolation.
Figure 6:
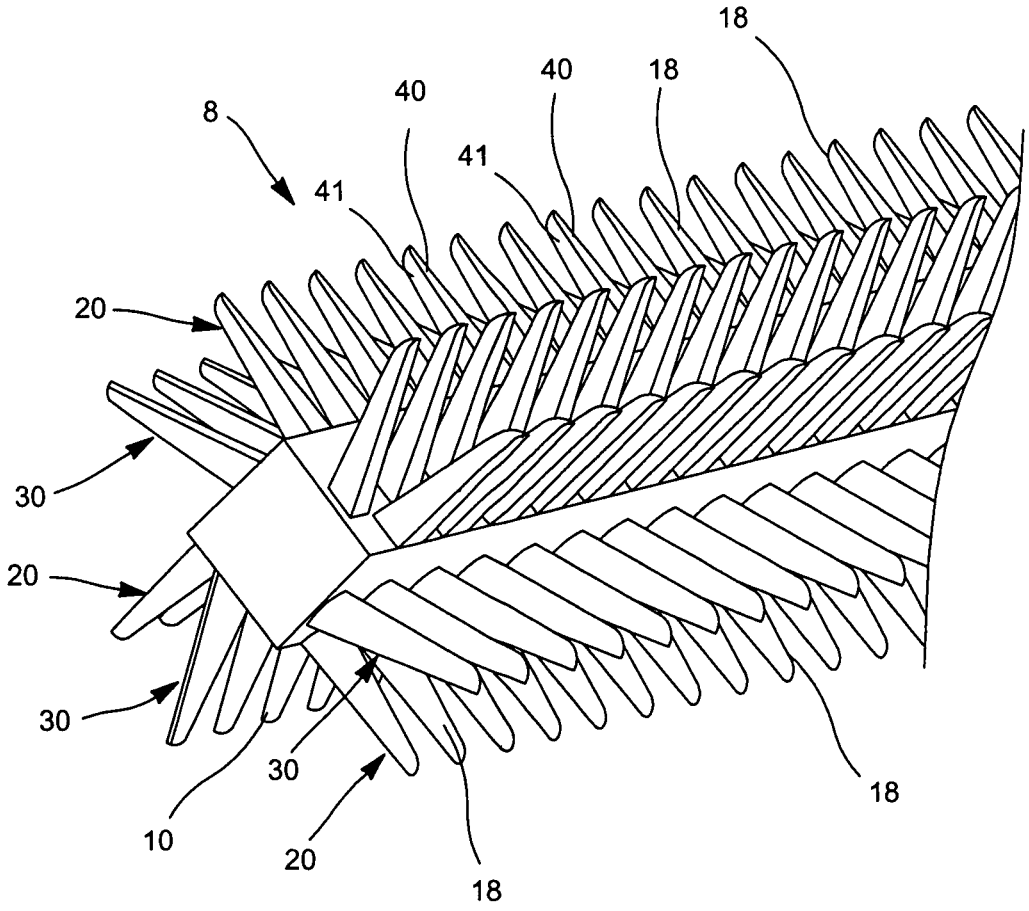
FIG. 6 is a diagrammatic and fragmentary perspective view of the FIG. 2 applicator member.
Figure 7:
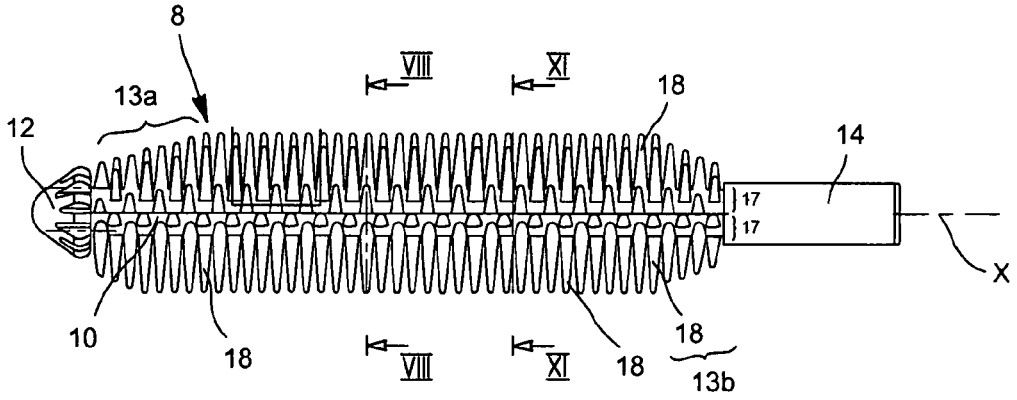
FIG. 7 is a view similar to FIG. 2 showing a variant embodiment.
Figure 8:
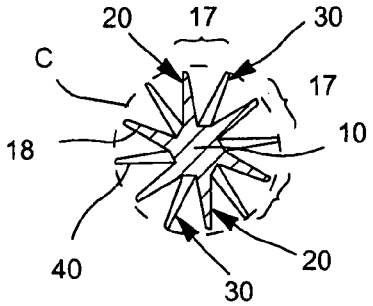
FIGS. 8 and 9 are cross-sections on VIII-VIII and IX-IX respectively in FIG. 7.
Figure 9:
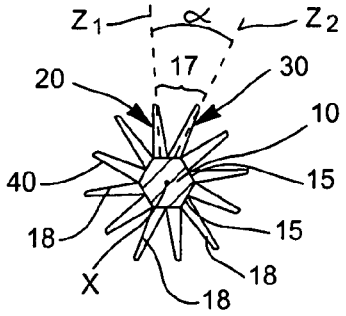
Figure 10:
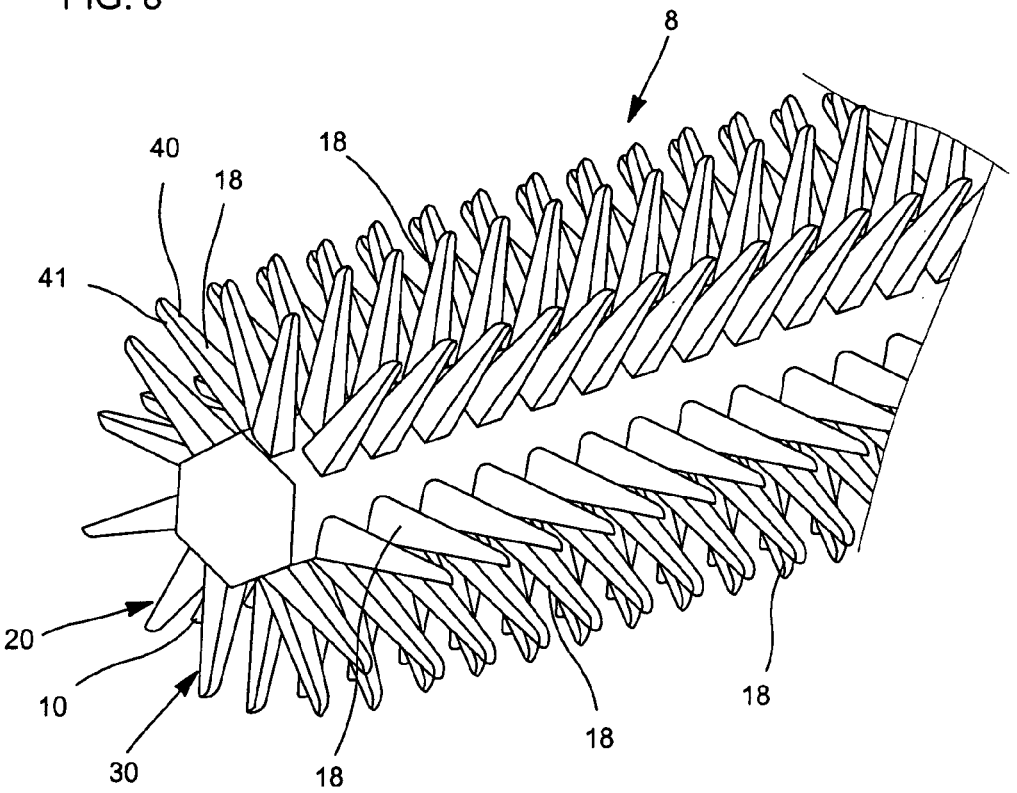
FIG. 10 is a diagrammatic and fragmentary perspective view of the FIG. 7 applicator member.

With reference to FIGS. 2 to 4, it can be seen that the applicator member 8 includes a core 10 of elongate shape that extends along a longitudinal axis X.

In the embodiment under consideration, the core 10 presents, over the majority of its length, a cross-section that is polygonal with sides that define longitudinal faces 15 that are substantially plane. The longitudinal axis X is central.

In the embodiment shown, a single row 17 of teeth 18 is connected to each of the longitudinal faces 15.

In the embodiment under consideration, the teeth 18 are made integrally with the core 10 by molding a thermoplastic material.

In order to mold the applicator member 8, it is possible to use a thermoplastic material that is optionally relatively rigid, e.g. styrene-ethylene-butylene-styrene (SEBS); a silicone rubber; butyl rubber; ethylene-propylene-terpolymer rubber (EPDM); a nitrile rubber; a thermoplastic elastomer; a polyester, polyamide, polyethylene, or vinyl elastomer; and also a polyolefin such as polyethylene (PE) or polypropylene (PP); polyvinyl chloride (PVC); polystyrene (PS); polyethylene terephthalate (PET); polyoxymethylene (POM); polyamide (PA); or polymethyl methacrylate (PMMA). In particular, it is possible to use materials known under the trade names Hytrel®, Cariflex®, Alixine®, Santoprene®, Pebax®, this list not being limiting.

Where appropriate, the applicator member 8 can also be made by molding a metal material or by machining.

The teeth and the core can be made of different materials.

The configuration of the teeth can facilitate molding by means of a mold comprising a plurality of shells that are respectively associated with different longitudinal faces 15, the shells being capable of moving apart from one another by being displaced radially outwards during unmolding.

The use of such shells makes it possible to avoid the teeth being unduly stressed mechanically during unmolding, and can enable a relatively-rigid thermoplastic material to be used in order to make the applicator member. The use of such a material can be desirable in order to increase the load of composition and/or to improve the way in which the composition is smoothed onto the eyelashes.

At its distal end 12, the applicator member 8 can include a head that tapers towards the front, so as to make it easier to put the applicator 2 back into the receptacle 3. The head tapering towards the front may reduce the risk of product accumulation on the applicator member 8. The height of the teeth 18 can reduce on moving closer to the head 12 along a distal transition portion 13*a*, as shown in FIG. 2.

The height of the teeth 18 can also reduce along a proximal transition portion 13*b* towards the stem 7, so as to make it easier for the applicator member 8 to pass through the wiper member 6 while the applicator 2 is being removed.

The head 12 can be circularly symmetrical or it can include radial fins as shown in FIG. 2.

In the embodiment under consideration, the core 10 is extended, at its proximal end, by a cylindrical endpiece 14 that enables it to be fastened on the stem 7. In particular, fastening may be performed by snap-fastening, adhesive, heat sealing, or crimping. The core 10 can also be molded integrally with the stem 7 or with a housing in which the stem 7 is inserted.

In the embodiment described, the longitudinal faces 15 are four in number, as can be seen in FIGS. 3 and 4, the cross-section of the core being substantially square.

Each row 17 of teeth 18 comprises a first set 20 of first teeth that are connected to the corresponding face 15 of the core 10 and that form an angle $\alpha_{Z1}$ with the normal, and a second set 30 of second teeth that are connected obliquely to the face 15 and that form an angle $\alpha_{Z2}$ with the normal. The angles $\alpha_{Z1}$ and $\alpha_{Z2}$ are measured in the plane of the cross-section that passes through the middle of the base of the tooth under consideration. At this point, the plane in question is perpendicular to the longitudinal axis of the core when said axis is rectilinear, and it is perpendicular to the tangent to the axis when said axis is curvilinear.

The teeth 18 of the first set of teeth 20 are straight, extending along a direction $Z_1$ that is substantially perpendicular to the face 15, the angle $\alpha_{Z1}$ being relatively small, e.g. less than 10°, or even 5°.

In the embodiment under consideration, the teeth 18 of the second set of teeth 30 are also straight, extending along a direction $Z_2$ and forming an angle $\alpha$ with the direction $Z_1$.

The angle $\alpha$ can lie in the range 20° to 80°, for example.

In FIGS. 3 and 4, it can be seen that each row comprises teeth each having a surface that is connected perpendicularly to the corresponding longitudinal face 15.

In the embodiment described, the teeth 18 of each row 17 are disposed in a staggered configuration. Two consecutive teeth 18 of each row 17 are offset alternately on opposite sides of a geometrical separation surface S, the surface S being a bisector plane that bisects the angle $\alpha$, for example.

The teeth of the first set 20 are disposed on one side of the geometrical separation surface S, while the teeth of the second set 30 are disposed on the other side of said geometrical separation surface S, when the core 10 is observed along its longitudinal axis.

Within each row 17, the bases of the teeth of the first set 20 and of the second set 30 are not in alignment, since they are respectively situated entirely on opposite sides of the geometrical separation surface S.

In the embodiment shown, the teeth of the first set 20 and of the second set 30 do not overlap, when the applicator member is observed from the side along a direction that is perpendicular to the axis X, as shown in FIG. 2.

When the core is observed along its longitudinal axis, as in FIG. 3, the free ends 18*a* of the teeth of the first set of teeth 20 are disposed beyond a mean circle C that is centered on the longitudinal axis X of the core, while the free ends 18*b* of the teeth of the second set 30 are disposed inside the circle. Thus, the free ends of the teeth of the applicator member 8 are not all at the same distance from the longitudinal axis of the applicator member.

Such a configuration makes it possible to improve the ability of the teeth 18 to penetrate into the eyelashes or the eyebrows, and it can improve the application of makeup or make application easier.

In addition, the directions $Z_1$ and $Z_2$ of the teeth 18 of the first and second sets 20 and 30 of teeth do not intersect the longitudinal axis X of the core, the teeth being off-center relative to said axis.

It should be understood on examining FIG. 3 in particular that the invention makes it possible to have teeth having free ends that are not all situated at the same distance from the longitudinal axis, and teeth that are relatively long if so desired, which can be advantageous for smoothing the eyelashes and for enabling the applicator to be loaded with composition.

It can be seen in FIGS. 2 to 4 that, in the embodiment shown, each tooth 18 of the first set 20 of a row 17 can be associated with a respective tooth of the first set 20 of another row 17, substantially occupying the same axial position along the axis X of the core, the passage from one tooth to another being performed by turning about the axis X through a submultiple of 360°, in this event 90°. The same applies for each tooth 18 of the second set 30.

Figure 5:
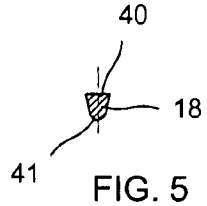
FIG. 5 is a cross-section of a tooth on V-V in FIG. 4.

The oblique teeth 18 of the various rows face in the same direction around the core, i.e. the clockwise direction in FIGS. 3 and 4. In the embodiment under consideration, each tooth 18 includes a first longitudinal face 40 of plane shape and a second longitudinal face 41 of rounded shape, in particular of convex shape, as can be seen in FIG. 5.

At least two consecutive teeth 18 of a row 17, and in the embodiment described all of the teeth of each row 17, have their first faces 40 having the same shape and their second faces 41 having the same shape, all of the first faces 40 facing in the same direction around the core 10, i.e. the anti-clockwise direction in FIGS. 3 and 4.

In the embodiment described, the first faces 40 of the teeth of the first set 20 of each row 17 extend in the plane of an adjacent face 15 of the core. In addition, the first faces 40 extend perpendicularly to the face 15 to which the teeth in question are connected.

The angle δ between the faces 40 and 41 of two consecutive teeth of a same row 17 is about 38°, for example, when the core is observed along its longitudinal axis, as in FIG. 4.

The free ends 18*a*, 18*b* of the teeth 18 of each set, when projected perpendicularly onto the corresponding longitudinal face 15, can lie in the proximity of the adjacent faces 15, as can be seen in FIG. 2.

The free ends 18*a* and 18*b* of the teeth of a row 17 can be situated substantially at the same height relative to the corresponding longitudinal face 15.

In addition, the bases of the consecutive teeth of each row 17 can optionally be touching, when the applicator member is observed from the side. In the embodiment under consideration, the bases are spaced apart slightly.

The core can include any number of longitudinal faces, with it being possible for any of the above-described characteristics to apply regardless of the number of longitudinal faces.

By way of example, FIGS. 7 to 10 show a variant embodiment in which the core 10 is of hexagonal cross-section and includes six longitudinal faces 15, a single row 17 of teeth 18 being connected to each of the longitudinal faces 15, such that the applicator includes six row 17 in all.

This embodiment also differs from the embodiment shown in FIGS. 1 to 6 by the fact that the teeth 18 of the first set of teeth 20 each include a plane face 40 that extends perpendicularly to the corresponding longitudinal face 15 of the core, but that does not extend in the plane of an adjacent longitudinal face 15.

In the embodiment in FIGS. 7 to 10, each row 17 includes teeth having plane faces 40 that face perpendicularly to the corresponding longitudinal face 15 of the core 10.

The free ends of the teeth are not situated at the same distance from the longitudinal axis X of the core 10, the free ends of the teeth that slope obliquely relative to the corresponding longitudinal face being further away from the axis X than the free ends of the other teeth.

Figure 11:
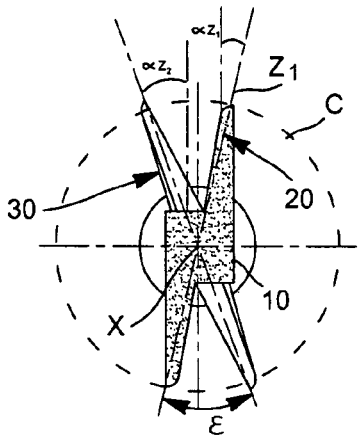
FIGS. 11 to 15 are cross-sections similar to FIG. 3 of variant embodiments.

FIG. 11 shows a variant embodiment in which the core 10 includes only two opposite longitudinal faces 15 from which there extend respective rows of teeth 17. In this embodiment, the core presents a square cross-section. The two rows are symmetrical about the longitudinal axis X.

Figure 12:
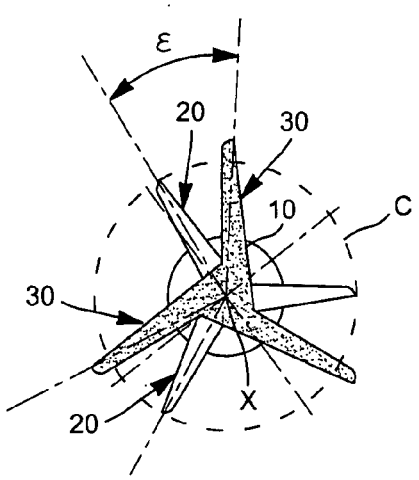

In the embodiment in FIG. 12, the cross-section of the core 10 is triangular, the core 10 presenting three longitudinal faces 15 and three corresponding rows 17 of teeth 18.

Figure 13:
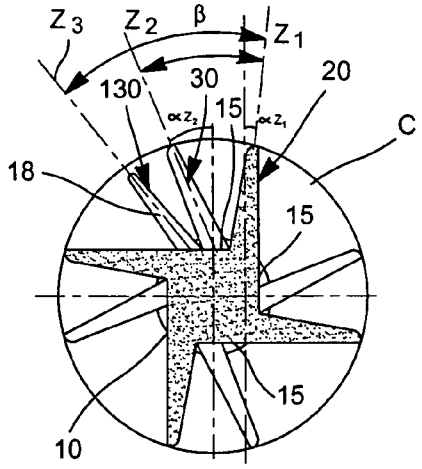

An applicator member 8 of the invention can include more than two visible teeth per longitudinal face, when the core is observed along its longitudinal axis, as shown in FIG. 13.

In this embodiment, in addition to the first and second teeth 18 of the sets 20 and 30, the applicator member 8 includes one or more additional teeth 18 that form an angle β with the direction $Z_1$ that is greater than the angle α, for example.

The additional teeth 18 constitute a third set 130 of teeth, and they can alternate with the teeth of the first and/or second set 20 and/or 30 of teeth along the row 17, for example. In a variant, the additional teeth 18 can constitute an additional row that extends parallel to the row 17.

The teeth of the third set 130 of teeth can extend in the same direction around the longitudinal axis of the core, as the teeth of the second sets 30 of the various rows, as shown.

In another variant, teeth of the applicator member need not all be oriented in the same direction around the core.

Figure 13A:
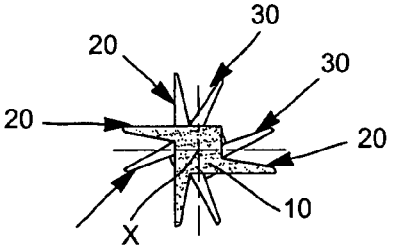

By way of example, FIG. 13A shows an applicator member in which one of the second sets of teeth 30 extends around the core in a direction that is opposite to the direction in which the other second sets of teeth extend around the core 10.

Figure 14:
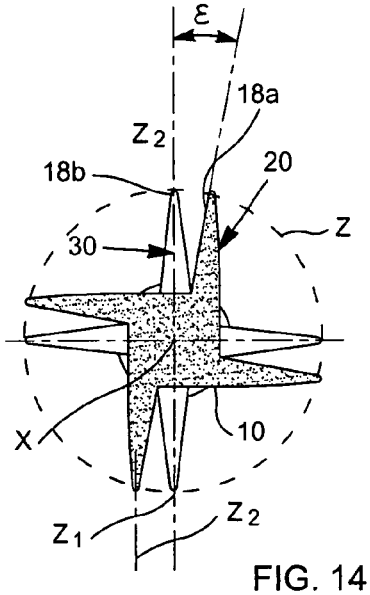

It is not beyond the ambit of the present invention for the teeth of the second set 30 of teeth not to slope relative to the longitudinal face 15 of the core to which they are connected, as in the variant shown in FIG. 14.

In this embodiment, the directions $Z_1$ and $Z_2$ are parallel for each row 17. The length of the teeth of the first set 20 is close to the length of the teeth of the second set 30. Nevertheless, in view of the fact that the teeth of the first set 20 are offset laterally relative to the teeth of the second set 30, and that the teeth are not disposed symmetrically about a mid-plane containing the axis X, the ends 18*a* of the teeth of the first set 20 of teeth are further away from the axis X than the ends 18*b* of the teeth of the second set 30.

The teeth of the second set are offset from the teeth of the first set sufficiently for their free ends 18*b* to be spaced apart angularly from the free ends 18*a* of the other teeth of the row by an angle $\epsilon$ about the axis X, the angle $\epsilon$ possibly being strictly non-zero, e.g. being greater than 1°, or 5°, or 10°, or even 15°.

In a variant not shown, the teeth of the first sets 20 in FIG. 14 can be replaced by the teeth of the first sets 20 in FIG. 13.

Figure 15:
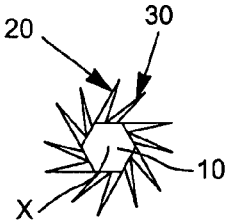

In another variant, all of the teeth, both those of the first set 20 and those of the second set 30, can extend with surfaces that are not perpendicular to the longitudinal face 15 to which they are connected, as shown in FIG. 15, the core presenting a hexagonal cross-section in this embodiment. The teeth can face in the same direction around the core, in this event the clockwise direction in FIG. 15.

In the embodiments described above, the longitudinal axis X of the core constitutes an axis of symmetry of the core 10, given that the core has a cross-section that is a regular polygon, in particular square, hexagonal, or triangular.

Still in the embodiments described above, the teeth of the first and second sets 20 and 30 of teeth 18 are disposed in a staggered configuration, with their bases not being in alignment.

Figure 16:
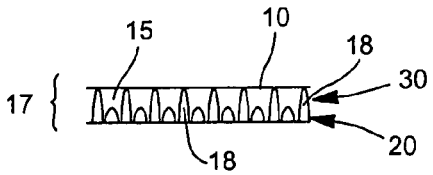
FIG. 16 is a fragmentary side view of a longitudinal face of the applicator constituting a variant embodiment.

This could be otherwise and the bases of the teeth 18 could be in alignment, as shown in FIG. 16, on a common line that is parallel to the longitudinal axis X of the core 10 intersecting all of the bases of the aligned teeth of the row.

The longitudinal faces 15 of the core 10 need not be plane, e.g. they could be concave or convex over at least a fraction of their length.

By way of example, FIGS. 17 to 20 show embodiments in which the core 10 includes longitudinal faces 15 that are concave at least in part, the concave shapes being centered on a mid-plane of the core 10, e.g. intersecting said core substantially half-way along.

Figure 17:
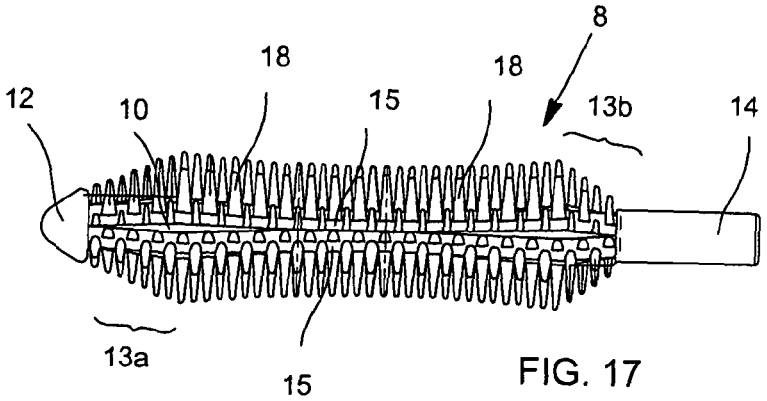
FIG. 17 is a view similar to FIG. 2 showing a variant embodiment.
Figure 18:
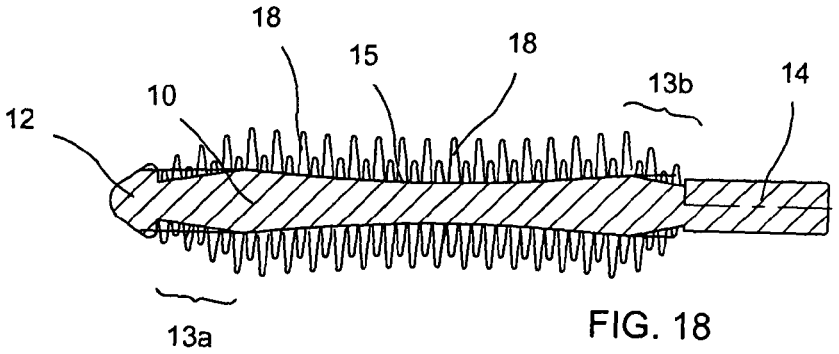
FIG. 18 is a diagrammatic and fragmentary longitudinal section of the FIG. 17 applicator member.
Figure 19:
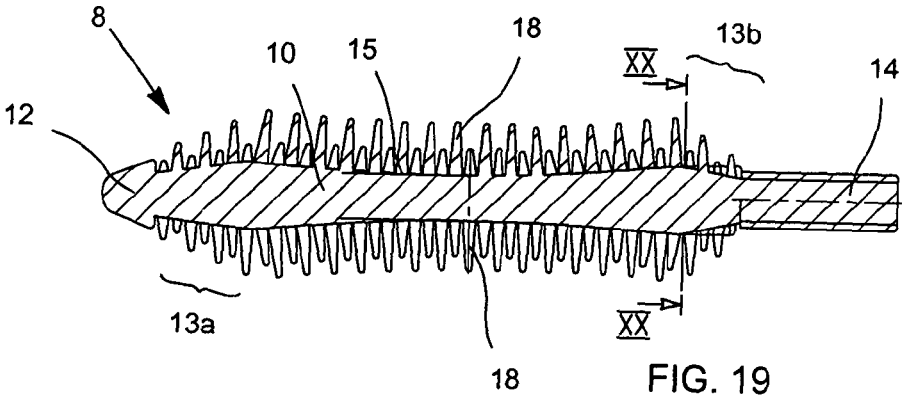
FIG. 19 is a view similar to FIG. 18 showing a variant embodiment.
Figure 20:
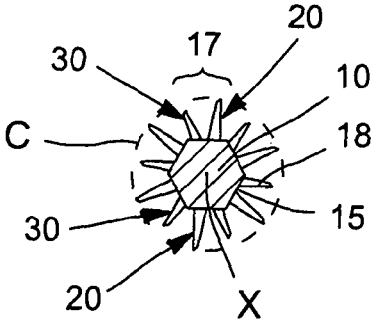
FIG. 20 is a diagrammatic and fragmentary cross-section on XX-XX in FIG. 19.

In the embodiment shown in FIGS. 17 and 18, the teeth 18 extend perpendicularly to the longitudinal axis X of the core 10, when the applicator member 8 is observed perpendicularly to said applicator member, and in the embodiment in FIGS. 19 and 20, the teeth 18 do not extend perpendicularly to the axis X of the core 10, but perpendicularly to the corresponding longitudinal face 15.

The concave shapes of the longitudinal faces 15 can be formed by a narrowing of the cross-section of the core 10.

Figure 21:
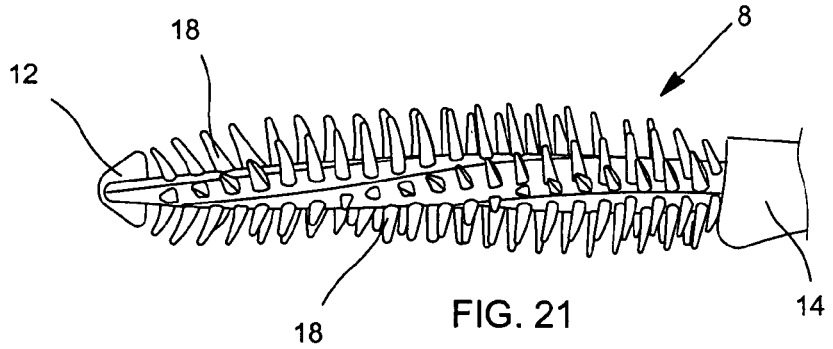
FIG. 21 is a perspective view of a variant embodiment.

In a variant embodiment, the longitudinal faces 15 of the core 10 are twisted, as shown in FIG. 21, i.e. the corresponding side turns through at least one turn towards the distal end of the core.

The core 10 can be deformed on unmolding by turning the endpiece 14, or, in a variant, it can be deformed in the mold.

Figure 22:
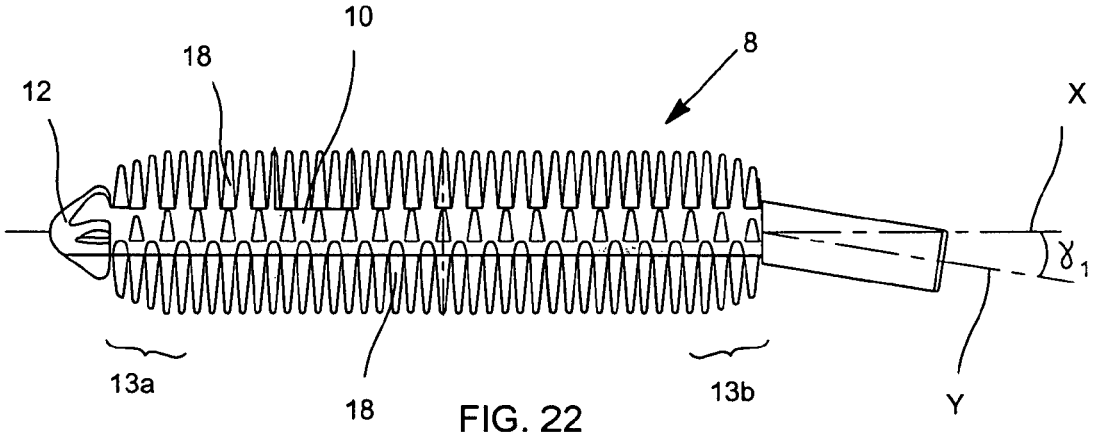
FIG. 22 is a view similar to FIG. 2 showing another variant.

The longitudinal axis X of the core 10 can coincide with the longitudinal axis Y of the stem 7, but it is not beyond the ambit of the present invention for this to be otherwise, and, by way of example, FIG. 22 shows a variant embodiment in which the longitudinal axis X of the core 10 forms an angle $\gamma_1$ with the longitudinal axis Y of the stem. Such a configuration can improve application by making it easier to manipulate the applicator.

Figure 23:
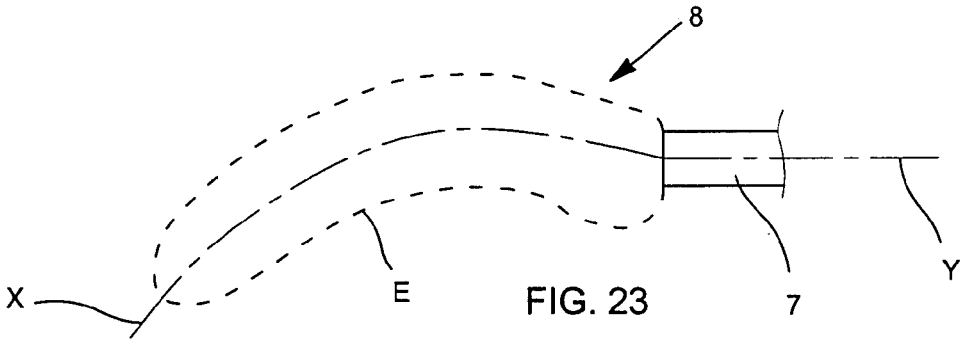
FIGS. 23 and 24 are diagrams of the envelope surfaces of other variant embodiments.

The core can extend along a longitudinal axis X that is not rectilinear. FIG. 23 shows a variant embodiment in which the core extends along a longitudinal axis X that is curved. When observed in longitudinal section, as on FIG. 23, the envelope surface E may comprise on a side of the axis X a first outline 54 extending substantially in the same direction as axis X, and on the opposite side of axis X a second outline 55 that may have a same curvature or a different curvature.

Figure 38:
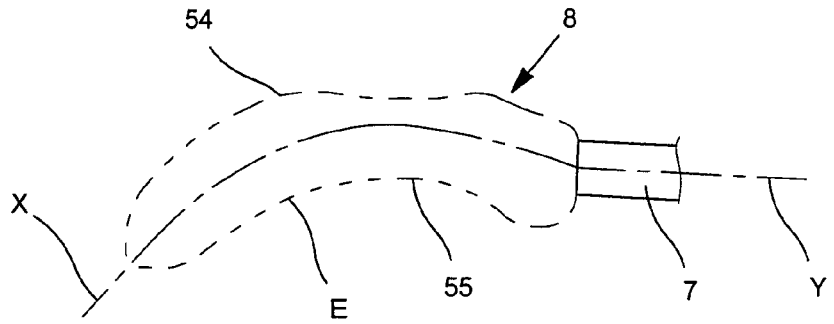
FIGS. 38 to 42 show in diagrammatic manner envelope surfaces of other variant embodiments.
Figure 39:
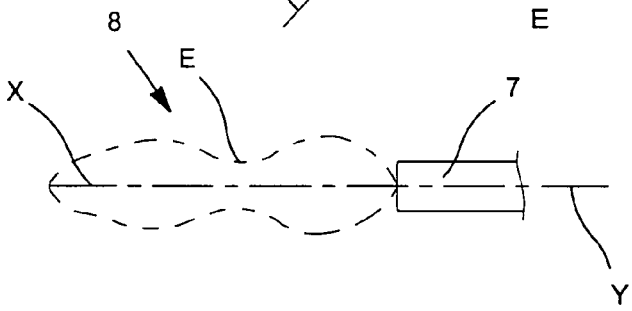
Figure 40:
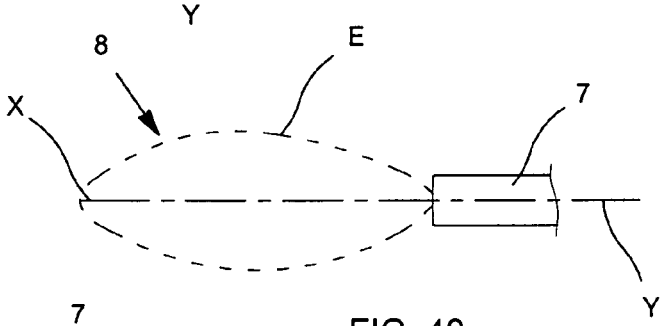

In the variant shown in FIG. 38, the envelope surface E has a cross section that goes through a minimum. The axis X coincides with axis Y. In the variant shown in FIG. 40, the longitudinal axis X of core 10 is rectilinear and the envelope surface E has an ovoidal shape.

Figure 24:
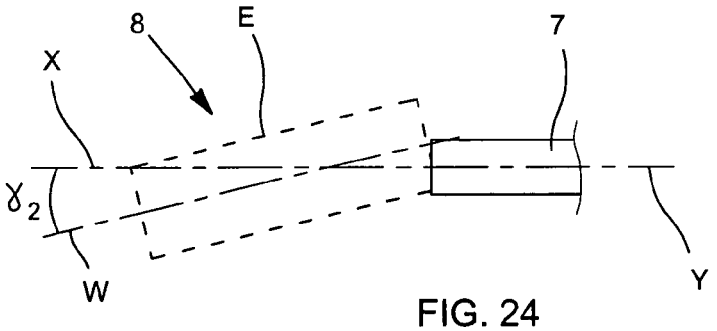

In another variant, shown in FIG. 24, the free ends of the teeth 18 define an envelope surface E that extends generally along a longitudinal axis W that forms an angle $\gamma_2$ with the longitudinal axis X of the core 10, where such an applicator could be said to be excentric.

Figure 41:
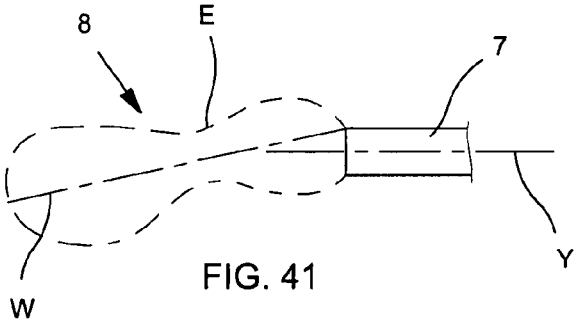
Figure 42:
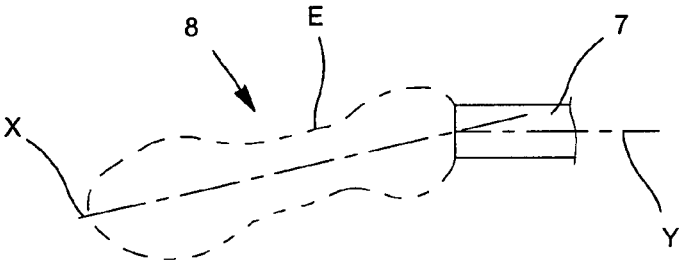

The variant of FIG. 41 differs from the variant of FIG. 24 by the shape of the envelope surface E, which shows a cross section that goes through a minimum. The longitudinal axis X of the core 10 may be rectilinear and make an angle with the longitudinal axis Y of the stem 7, as shown in FIG. 42, the surface envelope E having for example a non constant cross section, for example going through a minimum.

In order to use the device 1, the user can unscrew the closure cap 5 and remove the applicator member 8 from the receptacle 3.

After the applicator member 8 has passed through the wiper member 6, a certain quantity of composition remains between the rows 17 and between the teeth 18 of the rows, and can be applied to the eyelashes or the eyebrows by the user. The relatively large number of teeth and their disposition on the applicator member make it possible to apply makeup neatly. The wiping movement used to apply makeup to the eyelashes or the eyebrows can be accompanied by the applicator member being turned about the axis X. The obliquely-oriented teeth can be oriented towards the eyelashes when applying makeup.

FIGS. 30 to 37 relate to a variant embodiment of the applicator member.

In this embodiment, the core 10 presents a hexagonal cross-section that varies in size but not in shape.

The section increases over a first portion $l_1$, from the head 12 towards the proximal end, the first portion $l_1$ having, for example, a length that lies in the range 3 mm to 5 mm, e.g. close to 4.3 mm, the distance between two opposite faces 15 increasing from 1.9 mm to 2.9 mm, for example.

Figure 32:
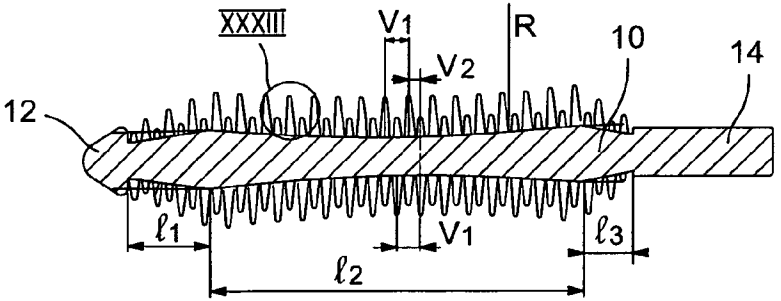
FIG. 32 is a longitudinal section on XXXII-XXXII in FIG. 31.

The cross-section decreases and increases over a second portion $l_2$, passing through a minimum, each face 15 presenting, in longitudinal section over said portion, a circularly-arcuate profile, as can be seen in FIG. 32, the length of the portion $l_2$ lying, for example, in the range 18 mm to 19 mm, e.g. close to 18.6 mm. The minimum of the cross-section is substantially mid-way along the portion 12, for example.

Then the core 10 decreases from the proximal end of the portion $l_2$ to the endpiece 14, the length of this portion $l_3$ lying, for example, in the range 2 mm to 3 mm, e.g. close to 2.5 mm.

The distance between two opposite faces 15 of the core 10 at the junction between the portions $l_2$ and $l_3$ lies, for example, in the range 2 mm to 3 mm, e.g. equal to 2.9 mm.

By way of example, the angular variation $v_1$ in the direction of the longitudinal axis of the teeth over the portion $l_2$ shown in FIG. 32, between two successive teeth of a same set, is 0.8°±1' of arc, and, between two adjacent teeth that belong respectively to the second and first sets of teeth, is equal to $v_2$, $v_2$ being 0.5°±1' of arc, for example.

By way of example, the radius of curvature R of the longitudinal faces 15 over the portion $l_2$ lies in the range 80 mm to 95 mm, e.g. close to 87 mm.

Figure 30:
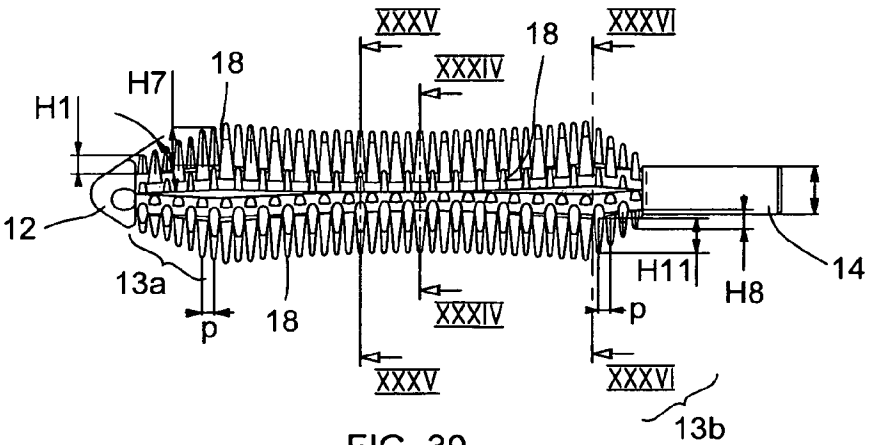
FIG. 30 is a view similar to FIG. 2 showing a variant embodiment of the applicator member.

The height of the teeth varies over the portion $l_1$, with heights that lie in the range 1 mm to 2 mm, for example, with height H1 being 1 mm, for example, for the teeth that are adjacent to the head 12, and increasing to heights H2 of 1.1 mm, H3 of 1.1 mm, H4 of 1.4 mm, H5 of 1.6 mm, H6 of 1.8 mm, and H7 of 2 mm, for example, for the successive teeth that are situated in the portion $l_1$, as shown in FIG. 30.

For the portion $l_3$, the height of the teeth decreases, e.g. from height H11 equal to 1.8 mm to height H8 equal to 1 mm, the heights of the intermediate teeth H10 and H9 being equal to 1.45 mm and 1.25 mm respectively, for example.

By way of example, the endpiece 14 presents a diameter that lies in the range 2 mm to 3 mm, e.g. 2.2 mm, and, by way of example, a length that lies in the range 6 mm to 8 mm, e.g. 7 mm, the diameter of the endpiece 14 being 2.2 mm at its proximal end and 2.4 mm at its distal end, for example.

By way of example, the tips of the teeth that are adjacent to the endpiece 14 are situated at a distance of about 0.375 mm from the endpiece 14.

Figure 35:
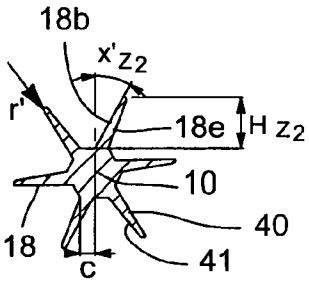
FIG. 35 is a cross-section on XXXV-XXXV in FIG. 30.
Figure 36:
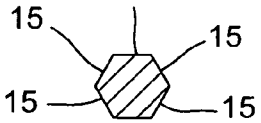
FIG. 36 is a cross-section on XXXVI-XXXVI in FIG. 30.
Figure 34:
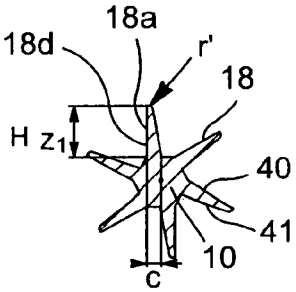
FIG. 34 is a cross-section on XXXIV-XXXIV in FIG. 30.

By way of example, the applicator member can include six rows, each having 42 teeth, each row including the teeth of the two alternating sets, the teeth within a row having successive flanks 18*d* that are perpendicular to the corresponding face of the core, as can be seen in FIG. 34, and successive flanks 18*e* that form an angle $\alpha'_{Z2}$ with the normal to the corresponding face of the core, as can be seen FIG. 35. By way of example, the angle $\alpha'_{Z2}$ lies in the range 25° to 30°, being about 27.9° in the embodiment shown.

In FIG. 34 and by way of example, the height $H_{Z1}$ of the teeth 18*a* lies in the range 2 mm to 3 mm, e.g. being 2.15 mm, and in FIG. 35 and by way of example, the height $H_{Z2}$ of the teeth 18*b* lies in the range 2 mm to 3 mm, e.g. being 2.2 mm.

The teeth 18*b* that extend obliquely relative to the normal to the corresponding face of the corresponding core present a height that is, for example, greater than the teeth 18*a* that are connected to the face at a smaller angle.

Figure 37:
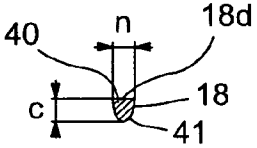
FIG. 37 is a cross-section of the base of a tooth.

With reference to FIG. 37, it can be seen that the base of a tooth 18 extends axially, for example, over a distance n that lies in the range 0.5 mm to 0.6 mm, e.g. about 0.55 mm, and in the circumferential direction it extends over a distance c that lies in the range 0.5 mm to 0.6 mm, e.g. about 0.55 mm.

By way of example, a tooth 18 presents a plane longitudinal face 18*d* or 18*e* that extends into the proximity of its free end, and on its opposite side, a convex face with a cross-section that is substantially semi-elliptical.

Figure 33:
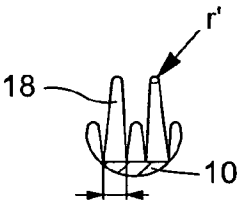
FIG. 33 shows a detail XXXIII of FIG. 32.

The end of a tooth can be rounded with a radius of curvature r of 0.1 mm, for example, when the applicator member is observed in a direction that is perpendicular to its longitudinal axis, as in FIG. 33, and with a radius of curvature r' that is 0.2 mm, for example, when the tooth is observed in cross-section, as in FIGS. 34 and 35.

The axial pitch $p_1$ between two adjacent teeth on the portion $l_1$ is 0.6 mm, for example, and said pitch can be the same on the portion $l_3$.

Figure 31:
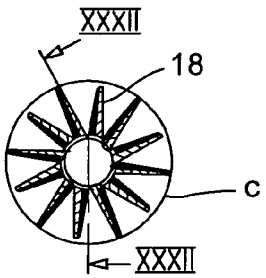
FIG. 31 is an axial view as seen looking along XXXI in FIG. 30.

The maximum diameter of the circle C enveloping the applicator member, as shown in FIG. 31, lies in the range 7 mm to 8 mm, e.g. being about 7.6 mm.

Naturally, the invention is not limited to the embodiments described above, the characteristics of which can be combined together within variants not shown.

The teeth of at least one row could present different heights, passing through an extremum between the extreme teeth of the row, for example.

At least one of the teeth 18 of the rows 17 could present a surface state that is not smooth, e.g. having ridges as a result of molding or roughness linked to the presence of a filler in the plastics material, for example.

The applicator member could be made with a plastics material that includes magnetic particles. The magnetic field created by such particles, that could be magnetizable and/or magnetized, could, for example, exert an effect on the eyelashes and/or interact with magnetic fibers or pigments that are present in the composition.

The applicator member could be made with flocking, said flocking extending over the teeth only, for example.

Figure 26:
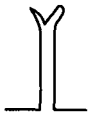
FIGS. 26 to 28 show variant embodiments of the teeth.
Figure 27:
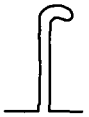
Figure 28:
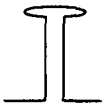

At their free ends, the teeth could present respective portions in relief or a particular shape, e.g. a fork, a hook, or a bead, as shown in FIGS. 26 to 28. By way of example, the hook could extend transversally, parallel, or obliquely relative to the longitudinal axis X of the core.

The rows 17 could include different numbers of teeth, with one of the rows being shorter than another, for example.

Within each row, the teeth could be grouped together, e.g. in groups of two. Naturally, the teeth could be grouped together other than in pairs, the spacing between the groups of teeth within the same row optionally being uniform, and in particular greater than the average spacing between the teeth within a group.

All of the teeth could be connected to the core along a direction that is contained in a plane that is perpendicular to the axis X. This could be otherwise, and teeth could slope towards the distal or proximal end.

The wiper member could be made in some other way, e.g. it could comprise a block of foam that could be slotted. The wiper member could be as described in patent applications FR 2 856 559, EP-A-1 046 358, EP-A-1 050 231, EP-A-1 481 607, and EP-A-1 561 394, for example.

Figure 25:
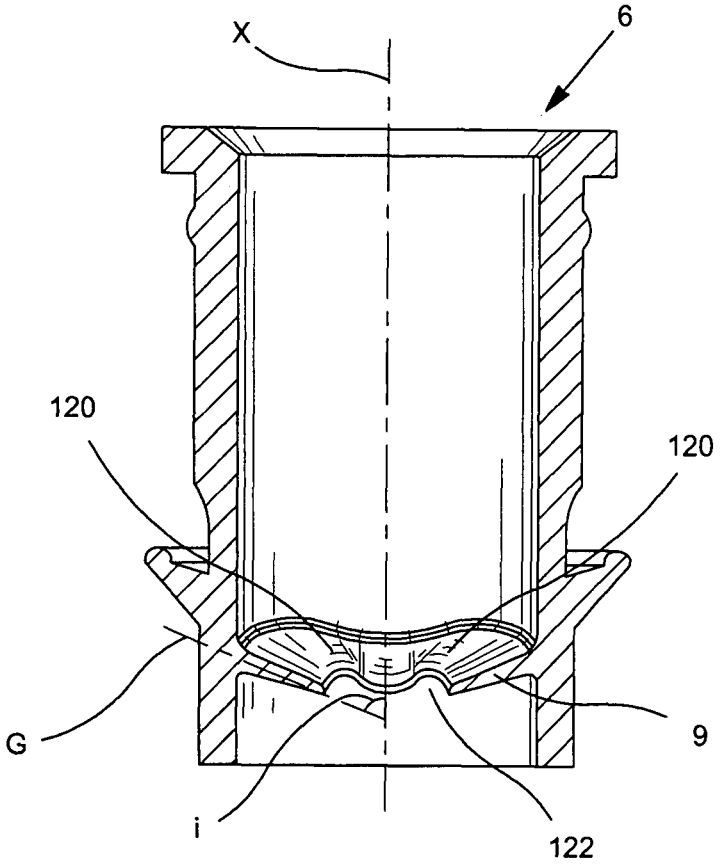
FIG. 25 is a diagrammatic and fragmentary axial of a variant embodiment of the wiper member.

The wiper member could also be as described in application WO 2007/004156, including at least one undulating wiper lip having a radially-inner free edge defining an orifice 122 through which the applicator member can pass, as shown in FIG. 25. The wiper member may be flexible and capable of deforming in extension and in bending. The wiper lip 9 could include undulations 120 that extend around the orifice 122. The number of undulations 120 of the wiper lip 9 could lie in the range 3 to 12, for example.

The wiper lip 9 could extend generally along a cone that converges towards the bottom of the receptacle, and that has a generator line G forming an angle i with the axis X of the receptacle. In a variant, the wiper lip 9 could extend generally along a mid-plane that is perpendicular to the axis X, or it could even extend generally along a cone that converges towards the outlet of the receptacle.

The wiper member could also be adjustable, where appropriate.

Figure 29:
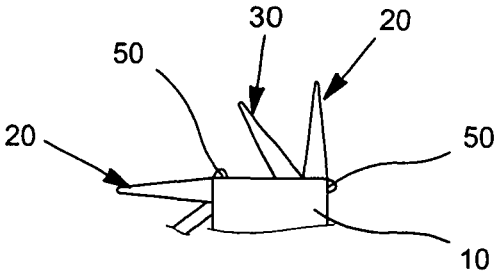
FIG. 29 is a fragmentary cross-section similar to FIG. 3 of a variant embodiment.

In a variant, the core 10 could include longitudinal ribs 50, as shown in FIG. 29, that enable it to be stiffened. The makes it possible to use a relatively flexible material, for example, to make the applicator member.

Flexible teeth could enable less composition to be stored on the applicator member after the applicator member 8 has passed through the wiper member 6, whereas more rigid teeth could enable a larger amount to be stored. Choosing the flexibility of the teeth makes it possible to control the amount of composition that is loaded on the applicator member, regardless of the kind of wiper member and regardless of the composition itself.

In variant embodiments of the invention, the free ends of the teeth of at least one row could be situated at the same distance from the longitudinal axis of the core. By way of example, such variants could take the arrangements of teeth and the shapes of core of the above-described figures, the lengths or slopes of the teeth being different so as to have free ends that are situated at the same distance from the longitudinal axis.

Figure 43:
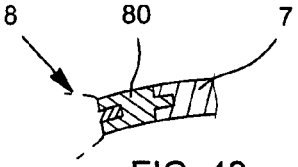
FIGS. 43 and 44 show details of variant embodiments of the stem.
Figure 44:
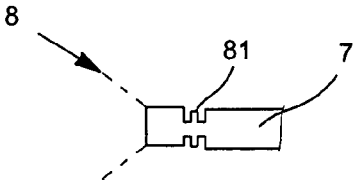

The stem 7 to which the core is fixed may be at least partially, for example entirely, flexible. The stem may for example comprise at least one flexible element 80 as shown in FIG. 43, or for example at least one elastomer element, or having a shape providing flexibility, for example at least one notch 81 as shown on FIG. 44.

The term "comprising a" should be understood as being synonymous with the term "comprising at least one" unless specified to the contrary.

The expression "lying in the range" should be construed as including the limits of the range.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a composition to eyelashes or eyebrows, the applicator comprising:

an elongate core that extends along a longitudinal axis and that has a plurality of longitudinal faces; and at least two sets of teeth, connected to at least two of the longitudinal faces of the core, each one of the at least two longitudinal faces of the core carrying only a single set of teeth, each set of teeth comprising a succession of teeth succeeding one another along the core, in which bases of the teeth are disposed in a staggered configuration, consecutive teeth of the set being offset at least in part, or completely, alternately on opposite sides of a geometrical separation surface, and each set consisting of:

a first subset of first teeth that are connected to a corresponding longitudinal face of the core and that form a first angle with the normal; and a second subset of second teeth that are connected to the corresponding longitudinal face of the core and that form a second angle with the normal, the core being observed along its longitudinal axis, wherein:

at least one of (i) the second angle is greater than the first angle, or (ii) at least one first tooth of the first subset and at least one second tooth of the second subset have free ends that are situated at different distances from the longitudinal axis of the core.

2. An applicator according to claim 1, the second angle being greater than the first angle.

3. An applicator according to claim 1, at least a first tooth of the first subset and a second tooth of the second subset of each of the at least two sets having free ends that are situated at different distances from the longitudinal axis of the core.

4. An applicator according to claim 1, at least a second tooth of the second subset being offset laterally on the core relative to at least one first tooth of the first subset, such that their respective free ends are spaced apart angularly by an angle that is strictly greater than 0°, about the longitudinal axis of the core.

5. An applicator according to claim 4, the angle being greater than 1°.

6. An applicator for applying a composition to eyelashes or eyebrows, the applicator comprising:

a core that extends along a longitudinal axis and that has a plurality of longitudinal faces; and at least two sets of teeth, connected to at least two of the longitudinal faces of the core, each one of the at least two longitudinal faces of the core carrying only a single set of teeth, each set of teeth comprising a succession of teeth succeeding one another along the core, in which bases of the teeth are disposed in a staggered configuration, consecutive teeth of the set being offset at least in part, or completely, alternately on opposite sides of a geometrical separation surface, and each set consisting of a first subset of first teeth and a second subset of second teeth, wherein the first subset of first teeth of said set have a surface that is connected obliquely or perpendicularly to a corresponding longitudinal face of the core, and the second subset of second teeth of said set have a surface that is connected obliquely to the corresponding longitudinal face of the core, when said core is observed along its longitudinal axis, at least one first tooth and at least one second tooth being connected to the corresponding longitudinal face of the core in different directions.

7. An applicator according to claim 6, the first teeth are connected obliquely to the corresponding longitudinal face of the core.

8. An applicator according to claim 6, the first teeth are connected perpendicularly to the corresponding longitudinal face of the core.

9. An applicator according to claim 1, in which the teeth of at least one set are connected to the corresponding longitudinal face of the core on the same side of a middle longitudinal line of the longitudinal face of the core.

10. An applicator according to claim 1, in which the teeth of at least one of the first subset of teeth or the second subset of teeth are substantially straight.

11. An applicator according to claim 1, in which at least two consecutive teeth of a set have first faces both having a common first shape, and second faces both having a common second shape different from the first shape, the first faces all facing in a same direction around the core.

12. An applicator according to claim 11, in which the first faces are planar.

13. An applicator according to claim 12, in which the first faces extend substantially flush with a longitudinal face of the core that is adjacent to the longitudinal face to which the teeth are connected.

14. An applicator according to claim 11, in which the first faces extend substantially perpendicularly to the corresponding longitudinal face of the core.

15. An applicator according to claim 1, in which at least one tooth of a set presents a surface that extends substantially perpendicularly to the face to which the tooth is connected.

16. An applicator according to claim 1, including 2 to 10 sets.

17. An applicator according to claim 1, in which the core extends along a longitudinal axis that is rectilinear.

18. An applicator according to claim 1, in which the core extends along a longitudinal axis that is curved.

19. An applicator according to claim 1, in which the core extends along a longitudinal axis that forms an angle with a longitudinal axis of a stem to which the core is fastened.

20. An applicator according to claim 19, in which the core is bent where the core connects to the stem.

21. An applicator according to claim 1, in which the free ends of the teeth define an envelope surface that extends along a longitudinal axis that forms a non-zero angle with the longitudinal axis of the core.

22. An applicator according to claim 1, in which the core includes at least one longitudinal face that is planar.

23. An applicator according to claim 1, in which the core includes at least one longitudinal face that is concave or convex at least in part.

24. An applicator according to claim 23, in which the core presents at least one longitudinal face that is twisted.

25. An applicator according to claim 1, including teeth of different heights.

26. An applicator according to claim 1, in which the teeth are made integrally with the core by molding, in particular by molding plastics material.

27. An applicator according to claim 1, in which the teeth are made of a material that is more rigid than a material that is used to make a stem of the applicator to which the core is connected.

28. An applicator according to claim 1, in which the teeth are made of a material that is less rigid than a material that is used to make a stem of the applicator to which the core is connected.

29. An applicator according to claim 1, in which the core is made of a plastics material that is more flexible than the plastics material that is used to make a stem of the applicator to which the core is connected.

30. An applicator according to claim 1, in which the core is made of a plastics material that is harder than the plastics material that is used to make a stem of the applicator to which the core is connected.

31. An applicator according to claim 1, in which the core is fastened to a first end of a stem that is connected at a second end, remote from the first, to a handle.

32. An applicator according to claim 1, the first angle lying in the range 0 to 10°.

33. An applicator according to claim 1, the angle between the directions along which the first and second teeth are connected to the core lying in the range 5° to 80°.

34. An applicator according to claim 1, the first teeth having a surface that extends in the plane of an adjacent longitudinal face of the core.

35. An applicator according to claim 1, the first and second teeth not having a surface that extends parallel to an adjacent longitudinal face of the core, when said core is observed along its longitudinal axis.

36. An applicator according to claim 1, the second teeth having a height that is greater than the height of the first teeth.

37. An applicator according to claim 1, two successive teeth of at least one of the first subset of first teeth or the second subset of second teeth having heights that are different.

38. An applicator according to claim 1, the core having a cross-section that varies substantially uniformly along its longitudinal axis.

39. An applicator according to claim 38, the core having a cross-section that increases over a first portion of the core, from a head towards a proximal end of the core, then decreases and increases over a second portion of the core, passing through a minimum, and decreases once again over a third portion of the core from the proximal end of the second portion to an endpiece.

40. An applicator according to claim 1, the core having a cross-section of polygonal shape.

41. An applicator according to claim 1, the applicator including 30 to 60 teeth on each of its longitudinal faces.

42. An applicator according to claim 1, each of the second teeth having a face that forms an angle with the normal to the face to which the tooth is connected that lies in the range 25° to 30°.

43. An applicator according to claim 1, the cross-section of the core being hexagonal.

44. An applicator according to claim 1, including, at a location along the longitudinal axis of the core, 10 to 15 teeth over 360° about the longitudinal axis of the core.

45. A packaging and applicator device for applying a composition to the eyelashes or the eyebrows, the device comprising an applicator according to claim 1, and a receptacle containing the composition.

46. A device according to claim 45, in which the receptacle includes a wiper member.

47. A device according to claim 46, the wiper member including an undulating lip.

48. An applicator according to claim 1, an envelope surface of the applicator comprising a proximal or distal portion of fruster, conical or pyramidal shape.

49. An applicator according to claim 6, the applicator comprising a plurality of sets of teeth extending from the plurality of longitudinal faces of the core, each longitudinal face of the core carrying the single set of teeth.

50. An applicator for applying a composition to eyelashes or eyebrows, the applicator comprising:

an elongate core that extends along a longitudinal axis and that has a plurality of longitudinal faces; and at least two sets of teeth, connected to at least two of the longitudinal faces of the core, each one of the at least two longitudinal faces of the core carrying only a single set of teeth, each set of teeth comprising a succession of teeth succeeding one another along the core, wherein bases of the teeth are disposed in a staggered configuration, consecutive teeth of the set being offset at least in part, or completely, alternately on opposite sides of a geometrical separation surface, and each set consisting of:

a first subset of first teeth that are connected to a corresponding longitudinal face of the core and that form a first angle with the normal; and a second subset of second teeth that are connected to the corresponding longitudinal face of the core and that form a second angle with the normal, the core being observed along its longitudinal axis, wherein:

at least one of (i) the second angle is greater than the first angle, or (ii) at least one first tooth of the first subset and at least one second tooth of the second subset have free ends that are situated at different distances from the longitudinal axis of the core;

the teeth of at least one of the first subset of teeth or the second subset of teeth are substantially straight; and at least two consecutive teeth of a set have first faces both having a common first shape, and second faces both having a common second shape different from the first shape, the first faces all facing in a same direction around the core.

51. An applicator for applying a composition to eyelashes or eyebrows, the applicator comprising:

a core that extends along a longitudinal axis and that has a plurality of longitudinal faces; and at least two sets of teeth, connected to at least two of the longitudinal faces of the core, each one of the at least two longitudinal faces of the core carrying only a single set of teeth, each set of teeth comprising a succession of teeth succeeding one another along the core, wherein bases of the teeth are disposed in a staggered configuration, consecutive teeth of the set being offset at least in part, or completely, alternately on opposite sides of a geometrical separation surface, and each set consisting of a first subset of first teeth and a second subset of second teeth, wherein:

the first subset of first teeth of said set have a surface that is connected obliquely or perpendicularly to a corresponding longitudinal face of the core, and the second subset of second teeth of said set have a surface that is connected obliquely to the corresponding longitudinal face of the core, when said core is observed along its longitudinal axis, at least one first tooth and at least one second tooth being connected to the corresponding longitudinal face of the core in different directions;

the teeth of at least one of the first subset of teeth or the second subset of teeth are substantially straight; and at least two consecutive teeth of a set have first faces both having a common first shape, and second faces both having a common second shape different from the first shape, the first faces all facing in a same direction around the core.

* * * * *